US009269245B2

(12) United States Patent
Park et al.

(10) Patent No.: US 9,269,245 B2
(45) Date of Patent: Feb. 23, 2016

(54) REGION OF INTEREST BASED VIDEO SYNOPSIS

(75) Inventors: Youngkyung Park, Seoul (KR); Shounan An, Seoul (KR); Undong Chang, Gyeonggi-Do (KR); Sungjin Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 828 days.

(21) Appl. No.: 12/920,981

(22) PCT Filed: Aug. 10, 2010

(86) PCT No.: PCT/KR2010/005242
§ 371 (c)(1),
(2), (4) Date: Sep. 3, 2010

(87) PCT Pub. No.: WO2012/020856
PCT Pub. Date: Feb. 16, 2012

(65) Prior Publication Data
US 2012/0038766 A1 Feb. 16, 2012

(51) Int. Cl.
*G08B 13/196* (2006.01)

(52) U.S. Cl.
CPC .... *G08B 13/19671* (2013.01); *G08B 13/19652* (2013.01)

(58) Field of Classification Search
None
See application file for complete search history.

(56) References Cited

U.S. PATENT DOCUMENTS 7,319,479 B1 * 1/2008 Crabtree et al. ..... 348/169
7,623,677 B2 * 11/2009 Girgensohn ..... G06F 17/30811 348/135
2003/0179294 A1 * 9/2003 Martins ..... G01S 3/781 348/157
2004/0141635 A1 * 7/2004 Liang et al. ..... 382/110
2006/0028488 A1 * 2/2006 Gabay et al. ..... 345/626
2006/0066719 A1 * 3/2006 Haering ..... G06K 9/00771 348/143
2006/0242186 A1 * 10/2006 Hurley ..... 707/102
2007/0121015 A1 5/2007 Gu
2008/0218591 A1 * 9/2008 Heier et al. ..... 348/150
2008/0232688 A1 * 9/2008 Senior et al. ..... 382/181
2009/0208054 A1 * 8/2009 Angell et al. ..... 382/103
2010/0013931 A1 * 1/2010 Golan et al. ..... 348/150
2010/0103175 A1 * 4/2010 Okutomi et al. ..... 345/428

FOREIGN PATENT DOCUMENTS

JP 2007-329788 A 12/2007

OTHER PUBLICATIONS

PCT International Search Report and Written Opinion dated May 26, 2011, for Application No. PCT/KR2010/005242, 12 pages.
Chinese Office Action dated Oct. 23, 2014 for Chinese Application No. 201080068516.X, 10 pages.

* cited by examiner

*Primary Examiner* — Frederick Bailey
*Assistant Examiner* — Edemio Navas, Jr.
(74) *Attorney, Agent, or Firm* — Fish & Richardson P.C.

(57) ABSTRACT

A region of interest based video synopsis methods, devices and systems are disclosed. One embodiment of the present disclosure pertains to a method of a server for generating a region of interest based video synopsis. The method comprises setting a region of interest (ROI) for an area tracked by a camera device communicatively coupled to the server in response to a receipt of region of interest configuration data. The method also comprises converting a video stream forwarded by the camera device while a moving object is active within the region of interest into metadata of the moving object. The method further comprises generating a video synopsis of the moving object active within the region of interest based on the metadata of the moving object.

16 Claims, 5 Drawing Sheets

| CONFIGURATION DATA 204 | TYPE 206 | ATTRIBUTE 208 | SHAPE 210 | PERIOD 212 |
|---|---|---|---|---|
| OBJECT(S) OF INTEREST | PERSON/ ANIMAL/ AUTOMOBILE WEAPON ⋮ | COLOR/ SIZE/ GENDER/ AGE/ ⋮ | | |
| REGION(S) OF INTEREST | | | POLYGON WITHIN AN AREA/ CIRCLE/ AN AREA DIVIDED BY LINE(S) ⋮ | |
| PERIOD(S) OF INTEREST | | | | MINUTE/ HOUR/ DAY/ WEEK/ MONTH/ ⋮ |

TABLE 202

REGION OF INTEREST BASED VIDEO SYNOPSIS

RELATED APPLICATIONS

The disclosures of PCT patent application No. WO 2007/057893 titled "Method and System for Producing a Video Synopsis" and PCT patent application No. WO 2008/093321 titled "Method and System for Video Indexing d Video Synopsis" are herein incorporated by reference.

FIELD OF TECHNOLOGY

Embodiments of the present disclosure relate to the field of electronics. More particularly, embodiments of the present disclosure relate to a video analysis device, system, and method.

BACKGROUND

Cameras, such as closed captioned television (CCTV) security cameras, are increasingly used to prevent crime. In some cities, tens of thousands of security cameras are installed to watch over suspicious persons or activities, thus raising a high expectation from the general public. However, such expectation had often been met with a poor result owing to the short attention span of a person monitoring the surveillance footage as well as the lack of manpower required to review the lengthy video footage. For instance, the attention span of an average person is about 20 minutes, and it can take a sizable manpower to review the surveillance footage recorded by several camera/recording devices 24 hours a day.

Video synopsis is an approach to create a short video summary of a long video. According to the method, moving objects are followed (e.g., tracked, traced, recorded, etc.), and video streams capturing the movements of the moving objects are converted into a database of objects and activities. Once the database is formed, when a summary of the moving objects is required, the moving objects from the target period are collected and shifted in time to create a much shorter synopsis video, in which the moving objects and activities that originally occurred in different times are displayed simultaneously.

SUMMARY

One embodiment of the present disclosure pertains to a method of an apparatus for generating a region of interest based video synopsis. The method comprises setting a region of interest (ROI) for an area tracked by a camera device communicatively coupled to the apparatus in response to a receipt of region of interest configuration data, where the region of interest is a portion of the area. The method also comprises converting a video stream forwarded by the camera device while a moving object is active within the region of interest into metadata of the moving object. The method further comprises generating a video synopsis of the moving object while the moving object is active within the region of interest based on the metadata of the moving object, where the video synopsis of the moving object is a short summary of the moving object active within the region of interest.

Another embodiment of the present disclosure pertains to a method of an apparatus for generating a region of interest based video synopsis. The method comprises tracking a moving object in an area using a camera device communicatively coupled to the apparatus for a time duration, where the camera device is configured to generate a video stream associated with the moving object. The method also comprises converting the video stream forwarded by the camera device during the time duration into metadata of the moving object, where the metadata is stored in a memory associated with the apparatus. The method further comprises setting one or more regions of interest for the area in response to a receipt of region of interest configuration data, where each of the regions of interest is a portion of the area. Moreover, the method comprises generating a video synopsis of the moving object while the moving object is active within the regions of interest based on the metadata of the moving object.

In yet another embodiment of the present disclosure pertains to an apparatus for generating a region of interest based video synopsis. The apparatus comprises a memory and a processor coupled to the memory, where the processor is configured to set a region of interest (ROI) for an area being surveilled in response to a receipt of region of interest configuration data. The processor is also configured to receive and convert a video stream associated with a moving object active within the region of interest into metadata of the moving object. The processor is further configured to generate a video synopsis of the moving object active within the region of interest based on the metadata of the moving object.

BRIEF DESCRIPTION OF THE DRAWINGS

Example embodiments are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

A method, device and/or system are disclosed that generate a region of interest based video synopsis of an object. According to embodiments of this disclosure, a region of interest may be designated for an area surveilled by a security system, where the security system includes a camera device and an apparatus (e.g., a server) which converts a video stream forwarded by the camera device to metadata processed for video synopsis. The region of interest is smaller than the area that can be covered by the camera device.

Once the region of interest is set, then the video stream forwarded by the camera device is processed and metadata of a moving object active within the region of interest is generated. Accordingly, the background information, unlike the information of the moving object, may not be repeatedly processed once it is registered with the apparatus. In addition, the information of the moving object which resides outside of the region of interest may not be processed, either. Once the metadata (e.g., time, position, etc.) of the moving object are generated, they may be used to generate or perform a video synopsis.

As described above, the region of interest based video synopsis of a moving object may substantially reduce time to review the recorded footages of the moving object without losing any essential information that needs to be checked. Further, the feature of the region of interest further improves the efficiency of video processing or analysis by selectively generating and storing metadata for the video synopsis while reducing or eliminating the production of unnecessary information.

Reference will now be made in detail to the embodiments of the disclosure, examples of which are illustrated in the accompanying drawings. While the disclosure will be described in conjunction with the embodiments, it will be understood that they are not intended to limit the disclosure to these embodiments. On the contrary, the disclosure is intended to cover alternatives, modifications and equivalents, which may be included within the spirit and scope of the disclosure. Furthermore, in the detailed description, numerous specific details are set forth in order to provide a thorough understanding of the present disclosure. However, it will be obvious to one of ordinary skill in the art that the present disclosure may be practiced without these specific details. In other instances, well known methods, procedures, components, and circuits have not been described in detail as not to unnecessarily obscure aspects of the present disclosure.

Figures 1, 2:
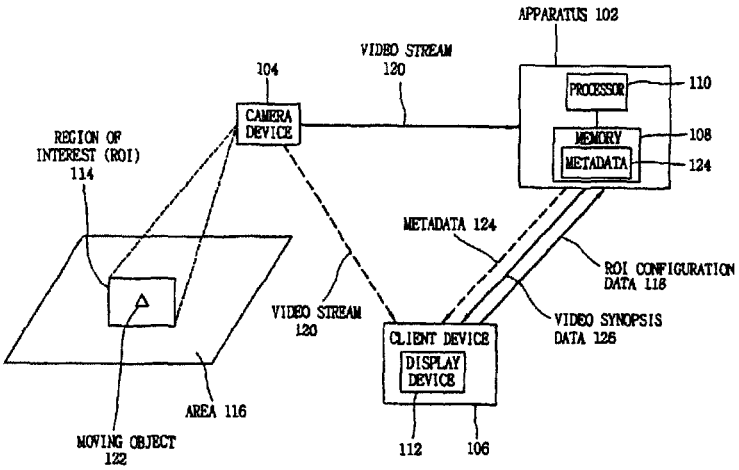
FIG. 1 illustrates an exemplary view of an apparatus for generating a region of interest based video synopsis interacting with other associative devices, according to one embodiment of the present disclosure.
FIG. 2 illustrates an exemplary view of a table illustrating configuration data associated with a video synopsis, according to one embodiment of the present disclosure.

FIG. 1 illustrates an exemplary view of an apparatus 102 for generating a region of interest based video synopsis interacting with other associative devices, according to one embodiment of the present disclosure. In FIG. 1, the apparatus 102 is communicatively coupled with a camera device 104 and a client device 106. It is appreciated that the apparatus 102, the camera device 104, and the client device 106 can be separate devices. It is also appreciated that any combination of the apparatus 102, the camera device 104, and the client device 106 can be realized to form a single device or two separate devices.

In FIG. 1, the apparatus 102 (e.g., a server, a digital video recorder, etc.) for generating a region of interest based video synopsis comprises a memory 108 and a processor 110 coupled to the memory 108. The processor 110 is configured to set a region of interest (ROI) 114 for an area 116 being surveilled in response to a receipt of region of interest configuration data 118 forwarded by the client device 106 (e.g., a computer, a mobile device, a mobile phone, a smart phone, etc.). It is appreciated that the region of interest 114 is smaller than the area 116 that can be processed by the camera device 104 (e.g., a video camera, a digital video recorder, etc.).

The processor 110 is also configured to receive and convert a video stream 120 forwarded by the camera device 104 which tracks (e.g., captures images of) a moving object 122 active within the region of interest 114 into metadata 124 of the moving object 122. It is appreciated that the conversion of the video stream 120 associated with the moving object 122 may be performed by object recognition (e.g., image recognition, face recognition, etc.) technology in computer vision, where the given object in images or video sequences of the video stream 120 is found. The processor is further configured to generate video synopsis data 126 of the moving object 122 active within the region of interest 114 based on the metadata 124 of the moving object 122. It is appreciated that the video synopsis data 126 of the moving object 122 is a short summary of the moving object 122 active within the region of interest 114. The video synopsis 126 is then displayed on a display device 112 of the client device 106.

In an alternative embodiment, the process executed by the apparatus 102 may be implemented in the client device 106. As illustrated in the dotted lines in FIG. 1, the client device 106 is configured to generate the video synopsis of the moving object 122 based on the video stream 120 forwarded by the camera device 105 and stored in a memory of the client device 106 as well as the metadata 124 forwarded by the apparatus 102 which, in this embodiment, is configured to generate the metadata 124 by processing the video stream 120.

FIG. 2 illustrates an exemplary view of a table 202 illustrating configuration data, according to one embodiment of the present disclosure. In FIG. 2, the table 202 displays configuration data 204, a type 206, an attribute 208, a shape 210, and a period 212. The configuration data 204 comprise an object of interest (or objects of interest), a region of interest (or regions of interest) and a period of interest (or periods of interest). The configuration data 204 used to set the object of interest may be defined by one or more of the type 206 and/or the attribute 208 of an object, where the type 206 comprises a person, animal, automobile weapon, etc., and where the attribute 208 of the object comprises a color, size, gender, age, etc.

In addition, the configuration data 204 used to set the period of interest may be based on the period 212, which may be in minute, hour, day, week, month, etc. Further, the configuration data 204 used to set the region of interest may be defined by the shape 210 of the region of interest, such as a polygon (e.g., a rectangle, square, etc.), circle, or a region formed by dividing the area surveilled by the camera device 104 of FIG. 1 with one or more lines.

Figure 3:
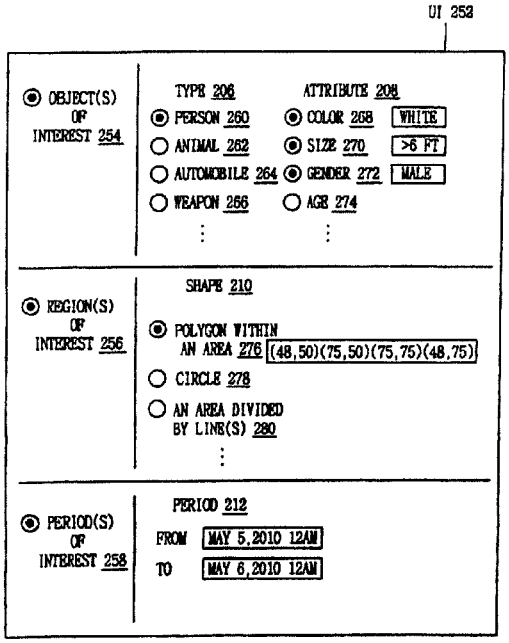
FIG. 3 illustrates an exemplary view of a user interface for setting the configuration data in FIG. 2, according to one embodiment of the present disclosure.

FIG. 3 illustrates an exemplary view of a user interface 252 for setting the configuration data 204 in FIG. 2, according to one embodiment of the present disclosure. In FIG. 3, the configuration data 204 is set by selecting object(s) of interest 254, region(s) of interest 256, and period(s) of interest 258 from the user interface (UI) 252. Then, a person 260 is selected as the type 206, and a color 268, a size 270, and a gender 272 are selected as the attribute 208. As a result, a 'white male taller than 6 ft.' is selected as the object of interest 254. In addition, a rectangle with coordinates of (48, 50), (75, 50), (75, 75), and (48, 75) is selected as the region of interest 256 through selecting a polygon within an area 276 as the shape 210. Further, the period 212 extending from 12 a.m., on May 5, 2010 to 12 a.m. on May 6, 2010 is selected as the period of interest 258.

Based on the setting of the configuration data 204 associated with the apparatus 102 in FIG. 1, the video synopsis data 126 which tracks a 'white male taller than 6 ft.' going in and out of the rectangle with the coordinates (48, 50), (75, 50), (75, 75), and (48, 75) viewed by the camera device 104 is processed for the time period which extends from 12 a.m., on May 5, 2010 to 12 a.m. on May 6, 2010. As illustrated in this example, by setting the configuration data 204 in a specific manner, the user of the apparatus 102 may reduce time and resources (e.g., data to process) for generating a video synopsis. It is appreciated that the user may choose to select a single category of the configuration data 204 rather than the combination of the three categories as illustrated in FIG. 3. For example, the user may choose to track just an object of interest or a region of interest. It is further appreciated that there can be more categories than the three categories illustrated in FIG. 3 and their respective subcategories.

Figure 4:
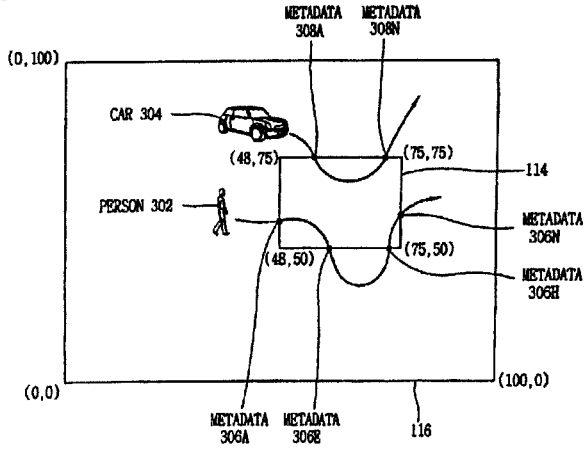
FIGS. 4 and 5 illustrate an exemplary view illustrating a process for generating a region of interest based video synopsis, according to one embodiment of the present disclosure.
Figure 5:
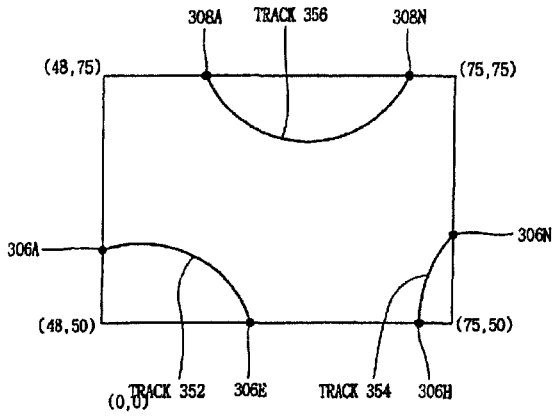

FIGS. 4 and 5 illustrate an exemplary view illustrating a process for generating a region of interest based video synopsis, according to one embodiment of the present disclosure. In FIG. 4, the region of interest 114 is set by assigning a polygonal shape (i.e., a rectangle) within the area 116 when region of interest configuration data (e.g., as in FIGS. 2-3) are processed by the apparatus (e.g., the apparatus 102) for generating a region of interest based video synopsis through a user interface associated with the apparatus.

In FIG. 4, metadata of two moving objects (e.g., a person 302 and a car 304) are generated by processing a video stream from a camera device (e.g., the camera device 104) tracking the two moving objects active within the region of interest 114. For instance, as the person 302 enters the region of interest 114 for the first time, metadata 306A is generated and the tracking of the person 302 (e.g., by the apparatus 102 and the camera device 104 of FIG. 1) is initiated, thus generating metadata periodically, intermittently, or based on other setting. As the person 302 leaves the region of interest 114, metadata 306E is generated. As the person 302 enters the region of interest 114 for the second time, metadata 306H is generated and the second tracking of the person 302 is initiated, thus generating metadata periodically, intermittently, or based on other setting until the person 302 leaves the region of interest 114. As the person 302 leaves the region of interest 114, metadata 306N is generated.

FIG. 4 also displays another moving object (e.g., the car 304). As the car 304 enters the region of interest 114, metadata 308A is generated and the tracking of the car 304 is initiated, thus generating metadata periodically, intermittently, or based on other setting until the car 304 leaves the region of interest 114. As the car 304 leaves the region of interest 114, metadata 308N is generated. In one embodiment, the metadata (e.g., the metadata 306A-E, the metadata 306H-N and the metadata 308A-N) of the moving objects (e.g., the person 302 and the car 304) comprise temporal data (e.g., recording time) and positional data (e.g., x, y, and z coordinates, altitude and longitude, etc.) of the moving objects.

Then, a trajectory of each moving object is formed based on the temporal data and the positional data. For example, the trajectory of the person 302 active within the region of interest 114 may be formed based on the temporal data and the positional data which correspond to the metadata 306A-E and 306H-N. Likewise, the trajectory of the car 304 moving within the region of interest 114 may be formed based on the temporal data and the positional data which correspond to the metadata 308A-N.

As the moving objects active within the region of interest 114 are being tracked, the remainder of the area 116 is masked or excluded from the tracking for the protection of privacy. That is, when a camera device controlled by the apparatus 102 for generating a ROI video synopsis has access to a wide area but targets only a portion of the area as in the case of the ROI based video synopsis, then the masking feature may be used to reduce the privacy concern which may be raised by those affected by the surveillance. In one example implementation, the portions of the video stream 120 in FIG. 1 which correspond to the surveillance of the remainder of the area 116 to be masked may not be stored in the apparatus 102. Likewise, the metadata 124 for the data which correspond to the surveillance of the remainder of the area 116 may not be generated at all. In another example implementation, the portions of the video stream 120 corresponding to the surveillance of the remainder of the area 116 may be stored in the apparatus 102, but the video synopsis data 126 which correspond to the remainder of the area 116 may be masked when the video synopsis data 126 is forwarded to the client device 106 for viewing.

In FIG. 5, a video synopsis of the moving objects is generated while the moving objects are active within the region of interest 114 based on the metadata of the moving objects. It is appreciated that the video synopsis of the moving objects is a short summary of the moving objects active within the region of interest 114. Thus, as illustrated in FIG. 5, the trajectory of the person 302 (e.g., track 352 and track 354) and the trajectory of the car 304 (e.g., track 356) can be displayed simultaneously although the trajectories of the two moving objects may have formed in two different time periods. With such a feature, the video synopsis of the two moving objects may substantially reduce time to review the recorded footages of the two moving objects without losing any essential information that needed to be checked. Further, the feature of the region of interest further improves the efficiency of video processing or analysis by selectively generating and storing metadata for the video synopsis while reducing or eliminating the production of unnecessary metadata.

Further, although FIGS. 4 and 5 illustrate the method of a video synopsis based on a region of interest, other configuration data, such as object of interest (or objects of interest), or a period of interest of FIGS. 2-3, alone or in combination with the region of interest, may be used generate a video synopsis in a similar manner described throughout this specification. For instance, metadata associated with the object of interest may be generated when the object of interest, rather than the region of interest, is selected as the configuration data for the video synopsis. For instance, if a person and red color are set as the type 206 and the attribute 208 of the object of interest, respectively, the metadata may be formed in such a way that allows the tracking and display of a person wearing a red cloth during the execution of video synopsis. Further, both the object of interest and the region of interest may be set in such a way that metadata of the moving object may be formed only when a person wearing a red cloth is moving within the region of interest.

Figure 6:
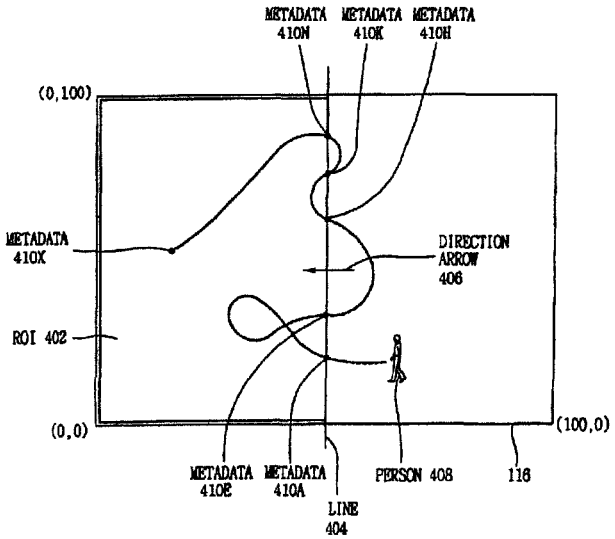
FIGS. 6 and 7 illustrate another exemplary view illustrating a process for generating a region of interest based video synopsis, according to one embodiment of the present disclosure.
Figure 7:
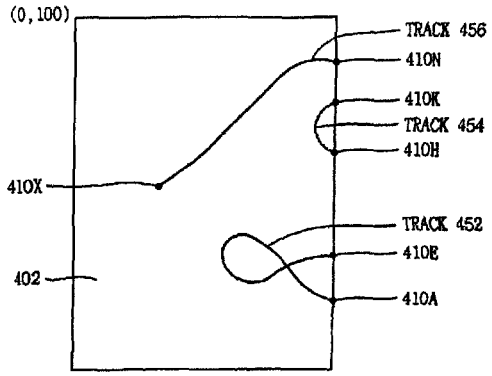

FIGS. 6 and 7 illustrate another exemplary view illustrating a process for generating a region of interest based video synopsis, according to one embodiment of the present disclosure. In one embodiment, a region of interest 402 may be formed by dividing the area 116 with a line 404 and by indicating one of the two regions with a direction arrow 406 formed by the line drawn across the area 116. In one example implementation, the formation of the region of interest 402 may be performed in response to the receipt of region of interest configuration data forwarded by a client device (e.g., a mobile phone, a computer, etc.).

In FIG. 6, metadata of a moving object (e.g., a person 408) is generated as a video stream from a camera device (e.g., the camera device 104) tracking the moving object while the moving object is active within the region of interest 402. For instance, as the person 408 enters the region of interest 402 for the first time, metadata 410A is generated and the tracking of the person 408 (e.g., by the apparatus 102 and the camera device 104 of FIG. 1) is initiated, thus generating metadata periodically, intermittently, or based on other setting. As the person 408 leaves the region of interest 402, metadata 410E is generated. Similarly, metadata 410H-K and metadata 410N-X are formed.

Then, a trajectory of each moving object is formed based on the temporal data and the positional data. For example, the trajectory of the person 408 active within the region of interest 402 may be formed based on the temporal data and the positional data which correspond to the metadata 410A-E and 410H-K, and 410N-X. As the moving object active within the region of interest 402 is being tracked, the remainder of the area 116 is masked or excluded from the tracking for the protection of privacy as illustrated in FIG. 4.

In FIG. 7, a video synopsis of the moving object is generated while the moving object is active within the region of interest 402 based on the metadata of the moving object. It is appreciated that the video synopsis of the moving object is a short summary of the moving objects active within the region of interest 402. Thus, as illustrated in FIG. 7, track 452, track 454, and track 456 formed by the person 408 in three different time periods can be displayed simultaneously.

Figure 8:
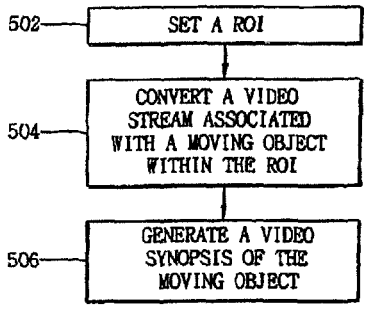
FIG. 8 illustrates a process flow chart of an exemplary method for generating a region of interest based video synopsis, according to one embodiment of the present disclosure.

FIG. 8 illustrates a process flow chart of an exemplary method for generating a region of interest based video synopsis, according to one embodiment of the present disclosure. In operation 502, a region of interest (ROI) is set for an area tracked by a camera device communicatively coupled to an apparatus for generating a region of interest based video synopsis in response to a receipt of region of interest configuration data. The region of interest is a portion of the area. In operation 502, a video stream forwarded by the camera device while a moving object is active within the region of interest is converted into metadata of the moving object. In operation 506, a video synopsis of the moving object active within the region of interest is generated based on the metadata of the moving object. In one example implementation, during the display of the video synopsis, the region of interest may be in high resolution as the region is surveilled or processed by a mega-pixel camera while the remainder of the area is in low resolution. The video synopsis of the moving object is a short summary of the moving object active within the region of interest. It is appreciated that the methods disclosed in FIG. 8 may be implemented in a form of a machine-readable medium embodying a set of instructions that, when executed by a machine, cause the machine to perform any of the operations disclosed herein.

Figure 9:
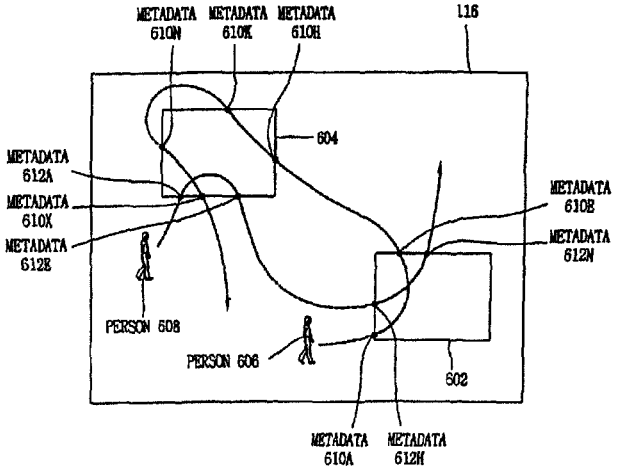
FIGS. 9 and 10 illustrate an exemplary view illustrating a process for generating a video synopsis based on two or more regions of interest, according to one embodiment of the present disclosure.
Figure 10:
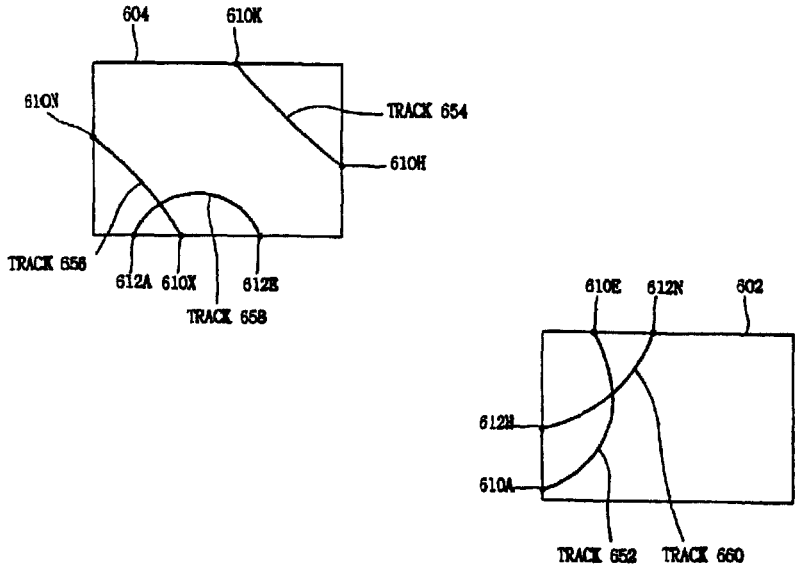

FIGS. 9 and 10 illustrate an exemplary view illustrating a process for generating a video synopsis based on two or more regions of interest, according to one embodiment of the present disclosure. In FIG. 9, a region of interest 602 and a region of interest 604 are set by assigning two polygons (e.g., two rectangles) within the area 116 according to region of interest configuration data (e.g., as in FIGS. 2-3) processed by a video synopsis apparatus (e.g., the apparatus 102).

In FIG. 9, metadata of two moving objects (e.g., a person 606 and a person 608) are generated by processing a video stream from a camera device (e.g., the camera device 104) tracking the two moving objects active within the region of interests. For instance, as the person 606 enters the region of interest 602 for the first time, metadata 610A is generated and the tracking of the person 606 (e.g., by the apparatus 102 and the camera device 104 of FIG. 1) is initiated, thus generating metadata periodically, intermittently, or based on other setting. As the person 606 leaves the region of interest 602, metadata 610E is generated. As the person 606 enters the region of interest 604, metadata 610H is generated and as the person 606 leaves the region of interest 604, metadata 61 OK is generated. In a like manner, metadata 610N-610X are generated.

FIG. 9 also displays another moving object (e.g., a person 608). As the person 608 is active within the region of interest 604, metadata 612A-E are generated. In addition, metadata 612H-N are generated while the person 608 is active within the region of interest 602. Each of the metadata (e.g., the metadata 610A-E, the metadata 610H-K, the metadata 610N-X, the metadata 612A-E, and the metadata 612H-N) of the moving objects (e.g., the person 606 and the person 608) comprise temporal data (e.g., recording time) and positional data (e.g., x, y, and z coordinates, altitude and longitude, etc.) of the moving objects.

Then, a trajectory of each moving object is formed based on the temporal data and the positional data. For example, the trajectory of the person 606 active within the regions of interest (e.g., 602 and 604) may be formed based on the temporal data and the positional data which correspond to the metadata 610A-E, the metadata 610H-K, and the metadata 610N-X. Likewise, the trajectory of the person 608 moving within the regions of interest may be formed based on the temporal data and the positional data which correspond to the metadata 612A-E, and the metadata 612H-N.

In FIG. 10, a video synopsis of the moving objects is generated while the moving objects are active within the regions of interest based on the metadata of the moving objects. Thus, as illustrated in FIG. 10, the trajectory of the person 606 (e.g., track 652, track 654, and 656) and the trajectory of the person 608 (e.g., track 658 and track 660) can be displayed simultaneously or according to each region of interest although the trajectories of the two moving objects may have formed in different time periods. Although FIGS. 9 and 10 illustrate the method of video synopsis based on two regions of interest, it is appreciated that three or more regions of interest may be configured to generate a video synopsis.

Figure 11:
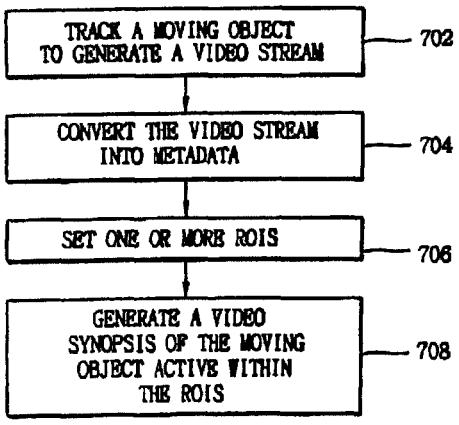
FIG. 11 illustrates a process flow chart of an exemplary method for generating one or more regions of interest based video synopsis, according to one embodiment of the present disclosure.

FIG. 11 illustrates a process flow chart of an exemplary method for generating one or more regions of interest based video synopsis, according to one embodiment of the present disclosure. In operation 702, a moving object active in an area is tracked using a camera device communicatively coupled to an apparatus for generating one or more region of interest based video synopsis for a time duration. In one embodiment, the camera device is configured to generate a video stream associated with the moving object. In operation 704, the video stream forwarded by the camera device during the time duration is converted into metadata of the moving object, and the metadata is stored in a memory associated with the apparatus. In operation 706, one or more regions of interest for the area are set in response to a receipt of region of interest configuration data, where each of the regions of interest is a portion of the area. In operation 708, a video synopsis of the moving object active within the regions of interest is generated based on the metadata of the moving object. In one example implementation, during the display of the video synopsis, the region of interest may be in high resolution as the region is surveilled or processed by a mega-pixel camera while the remainder of the area is in low resolution. It is appreciated that the methods disclosed in FIG. 11 may be implemented in a form of a machine-readable medium embodying a set of instructions that, when executed by a machine, cause the machine to perform any of the operations disclosed herein.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and features disclosed herein.

What is claimed is:

1. A method of generating, by an apparatus, a region-of-interest-based video synopsis, the method comprising:

setting, in response to a receipt of information related to a region of interest (ROI), the region of interest for an area tracked by a camera device that is communicatively coupled to the apparatus, wherein the region of interest is a portion of the area;

receiving a video stream from the camera device when a movement of one or more objects in the region of interest is detected;

determining whether at least one of the detected one or more objects in the region of interest is an object of interest based on information related to the object of interest, wherein the information related to the object of interest is set by a user;

generating, using the received video stream, information related to two or more tracks of the object of interest moving within the region of interest if it is determined that at least one of the detected one or more objects in the region of interest is the object of interest and that the object of interest moves within the region of interest, wherein the information related to two or more tracks of the object of interest moving within the region of interest is not generated if it is determined that at least one of the detected one or more objects is not the object of interest;

generating, based on the information related to two or more tracks of the object of interest moving within the region of interest, a video synopsis related to the two or more tracks of the object of interest moving within the region of interest, wherein at least two of the two or more tracks of the object of interest that moves within the region of interest are formed in different time periods; and displaying the video synopsis such that the two or more tracks formed in different time periods are displayed at the same time while masking a remainder region that is different from the region of interest in the area.

2. The method of claim 1, wherein setting the region of interest comprises assigning a polygonal shape within the area as the region of interest in response to the receipt of the information related to the region of interest that indicates the region of interest.

3. The method of claim 2, wherein the polygonal shape comprises a rectangle.

4. The method of claim 1, wherein setting the region of interest comprises assigning one of two regions of the area formed by a line drawn across the area in response to the receipt of the information related to region of interest that indicates the region of interest.

5. The method of claim 1, wherein the information related to two or more tracks of the object of interest moving within the region of interest comprise temporal data of the object of interest and positional data of the object of the interest.

6. The method of claim 5, wherein the video synopsis related to tracks of the object of interest that moves within the region of interest is generated based on the temporal data and the positional data.

7. A method of generating, by an apparatus, a region-of-interest-based video synopsis, the method comprising:

setting at least one region of interest for an area in response to a receipt of information related to a region of interest, wherein the at least one region of interest is a portion of the area;

receiving a video stream from the camera device when a movement of one or more objects in the at least one region of interest is detected;

determining whether at least one of the detected one or more objects in the at least one region of interest is an object of interest based on information related to the object of interest, wherein the information related to the object of interest is set by a user;

generating, using the received video information, information related to two or more tracks of the object of interest moving within the at least one region of interest if it is determined that at least one of the detected one or more objects in the at least one region of interest is the object of interest and that the object of interest moves within the at least one region of interest, wherein the information related to two or more tracks of the object of interest moving within the region of interest is not generated if it is determined that at least one of the detected one or more objects is not the object of interest, and wherein the generated information related to two or more tracks of the object of interest moving within the region of interest is stored in a memory associated with the apparatus;

generating, based on the information related to two or more tracks of the object of interest moving within the at least one region of interest, a video synopsis related to the two or more tracks of the object of interest moving within the at least one region of interest, wherein at least two of the two or more tracks of the object of interest that moves within the region of interest are formed in different time periods; and displaying the video synopsis such that the two or more tracks formed in different time periods are displayed at the same time while masking a remainder region that is different from the at least one region of interest in the area.

8. The method of claim 7, wherein setting the at least one region of interest comprises assigning a polygonal shape within the area as each of the at least one region of interest in response to the receipt of the information related to region of interest that indicates the at least one region of interest.

9. The method of claim 8, wherein the polygonal shape comprises a rectangle.

10. The method of claim 7, wherein the information related to two or more tracks of the object of interest moving within the at least one region of interest comprise temporal data of the object of interest.

11. The method of claim 10, wherein the information related to two or more tracks of the object of interest moving within the at least one region of interest further comprises positional data of the object of interest.

12. The method of claim 11, wherein the video synopsis related to tracks of the object of interest that moves within the at least one region of interest is generated based on the temporal data and the positional data.

13. The method of claim 7, wherein the at least one region of interest consists of a single region of interest.

14. The method of claim 7, wherein the at least one region of interest comprises at least two regions of interest.

15. An apparatus configured to generate a region-of-interest-based video synopsis, the apparatus comprising:

a memory; and a processor coupled to the memory and configured to:

set, in response to a receipt of information related to a region of interest (ROI), the region of interest for an area being surveilled, wherein the region of interest is a portion of the area;

receive a video stream from the camera device when a movement of one or more objects in the region of interest is detected;

determine whether at least one of the detected one or more objects in the region of interest is an object of interest based on information related to the object of interest, wherein the information related to the object of interest is set by a user;

generate, using the received video stream, information related to two or more tracks of the object of interest moving within the region of interest if it is determined that at least one of the detected one or more objects in the region of interest is the object of interest and that the object of interest moves within the region of interest, wherein the information related to two or more tracks of the object of interest moving within the region of interest is not generated if it is determined that at least one of the detected one or more objects is not the object of interest;

generate, based on the information related to two or more tracks of the object of interest moving within the region of interest, a video synopsis related to the two or more tracks of the object of interest moving within the region of interest, wherein at least two of the two or more tracks of the object of interest that moves within the region of interest are formed in different time periods; and display the video synopsis such that the two or more tracks formed in different time periods are displayed at the same time while masking a remainder region that is different from the region of interest in the area.

16. The apparatus of claim 15, wherein the video synopsis is displayed on a display module coupled with the processor.

* * * * *